US007938654B2

(12) United States Patent
Stein

(10) Patent No.: US 7,938,654 B2
(45) Date of Patent: May 10, 2011

(54) GENTLE DISCONNECT CONNECTOR FOR PRINTED CIRCUIT BOARDS AND TOOL THEREFOR

(75) Inventor: Casey Roy Stein, Surprise, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 12/492,420

(22) Filed: Jun. 26, 2009

(65) Prior Publication Data

US 2010/0330819 A1 Dec. 30, 2010

(51) Int. Cl.
*H01R 13/62* (2006.01)

(52) U.S. Cl. ..... 439/152; 439/63; 29/762; 29/764

(58) Field of Classification Search ..... 439/63, 439/152; 29/762, 426.1, 426.5, 750, 758, 29/752

See application file for complete search history.

(56) References Cited

U.S. PATENT DOCUMENTS

| | | | | | |
|---|---|---|---|---|---|
| 1,422,185 | A | * | 7/1922 | Dalitz | 29/763 |
| 3,844,013 | A | * | 10/1974 | Hall, Jr. | 29/764 |
| 4,125,938 | A | * | 11/1978 | Clark | 29/764 |
| 4,881,912 | A | | 11/1989 | Thommen et al. | 439/585 |
| 5,746,619 | A | | 5/1998 | Harting et al. | 439/352 |
| 5,954,708 | A | | 9/1999 | Lopez et al. | 604/533 |
| 6,062,607 | A | | 5/2000 | Bartholomew | 285/93 |
| 6,361,348 | B1 | | 3/2002 | Hall et al. | 439/352 |
| 6,409,534 | B1 | | 6/2002 | Weisz-Margulescu | 439/367 |
| 6,450,829 | B1 | | 9/2002 | Weisz-Margulescu | 439/352 |
| 6,663,397 | B1 | | 12/2003 | Lin et al. | 439/63 |
| 6,793,528 | B2 | | 9/2004 | Lin et al. | 439/582 |
| 6,955,563 | B1 | | 10/2005 | Croan | 439/578 |
| 7,291,033 | B2 | | 11/2007 | Hu | 439/347 |
| 7,335,058 | B1 | | 2/2008 | Burris et al. | 439/578 |
| 7,396,249 | B2 | | 7/2008 | Kauffman | 439/349 |

* cited by examiner

*Primary Examiner* — Ross N Gushi
(74) *Attorney, Agent, or Firm* — Matthew J. Mason

(57) ABSTRACT

An electrical connector has a first and second connector body. A tool fits over the first connector body to assist in demating the two connector bodies from one another. Compressing the tool compresses spring fingers in one of the connector bodies, allowing the connector bodies to be easily demated from one another without excessive force and damaging printed circuit boards to which the connector may be connected.

7 Claims, 6 Drawing Sheets

GENTLE DISCONNECT CONNECTOR FOR PRINTED CIRCUIT BOARDS AND TOOL THEREFOR

BACKGROUND OF THE INVENTION

1. Field of the Invention

The present invention relates generally to gentle disconnect connectors and a tool therefor, and particularly to push-pull connectors that more gently disconnect from printed circuit boards and only when the unmating of the connector from the printed circuit board is desired.

2. Technical Background

Coaxial connectors are used to connect with electrical connectors on printed circuit boards (PCBs). The electrical connectors on the PCBs are soldered to metallic traces on the PCBs, which in turn are laminated to the board material. Typical electrical connections between the PCB connector and coaxial connectors are of the push-pull type. These connections are known to cause a delamination of the soldered connections and the metallic traces on the PCBs themselves when the connectors are unmated due to the typically higher resistance required to unmate them.

Prior coaxial connectors used on PCBs have attempted to solve this problem by making the connection between the coaxial cable and the electrical connector easier to unmate (easier to pull), but that allowed the coaxial cable to become unmated when it was not desired, causing an unwanted interruption of the electrical systems. Other attempts to provide a stable connection have been to secure the connectors after they have been assembled. One such attempt includes use of an epoxy to encase the mated connector pair. This procedure can be costly as well as time consuming. Additionally use of epoxy encasement makes disconnection for repair and/or replacement difficult if not impossible rendering the whole interconnect system virtually useless.

It would be desirable therefore to provide an electrical connector and a tool that can be used on PCBs that allows for gently unmating of the push-pull electrical connector only at desired times.

SUMMARY OF THE INVENTION

Disclosed herein is a tool for releasing a first connector body from a second connector body that is connected to a printed circuit board that includes a generally circular first portion having a front end and rear end and an opening therebetween for receiving a portion of the first connector body, the front end having a first diameter and the rear end having a second diameter, the first diameter being smaller than the second diameter and at least two extensions connected to the rear end of the first portion and extending generally away from the front end of the first portion, wherein pressing on the at least two extensions causes the first diameter to become smaller.

In some embodiments, the tool includes an opening extending along a side of the first portion between the front end and the rear end.

In some embodiments, the tool includes a projection radially extending from the rear end of the first portion to connect each of the at least two extensions to the first portion, the projections being sized to extend beyond the first connector body.

In other embodiments, the tool is disposed over a portion of the first connector body, the first connector body having a front end, a back end, and a middle portion, and having at least two spring fingers between the front end and the middle portion, the front end of the tool engaging the at least two spring fingers, and at least a portion of the first connector body and a portion of the tool fit into an opening in a front end of the second connector body.

In another aspect, an electrical connector is disclosed for connecting a printed circuit board and a coaxial cable that includes a first connector body having a front end, a back end, and a middle portion, and having at least two spring fingers between the front end and the middle portion, a tool to release the first connector body having a first portion to engage the at least two spring fingers and at least two extensions connected to the first portion and extending beyond the first connector body, wherein pressing on the at least two extensions compresses the at least two spring fingers, and a second connector body having an opening therein to receive at least a portion of the tool and at least a portion of the first connector body.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
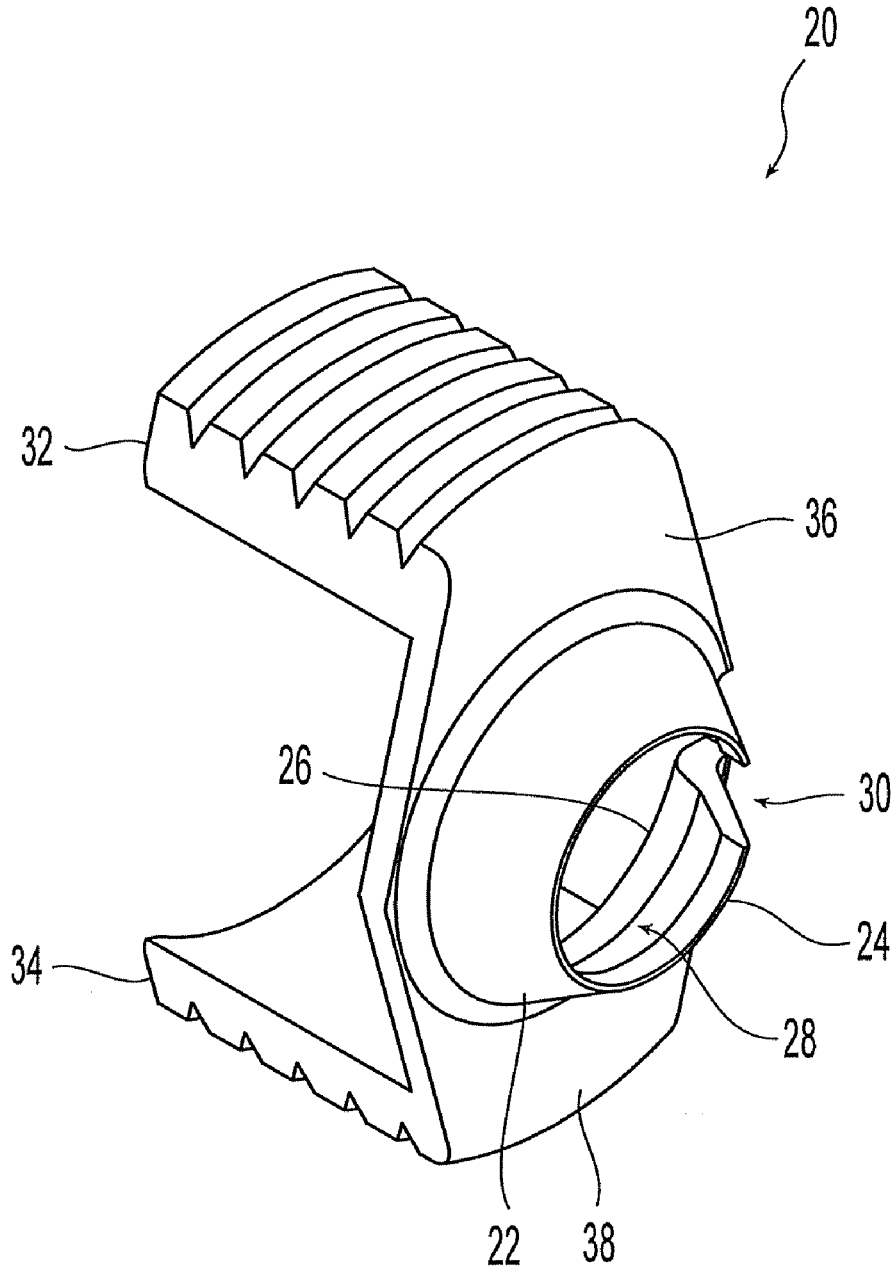
FIG. 1 is a perspective view of one embodiment of a tool according to the present invention.
Figure 2:
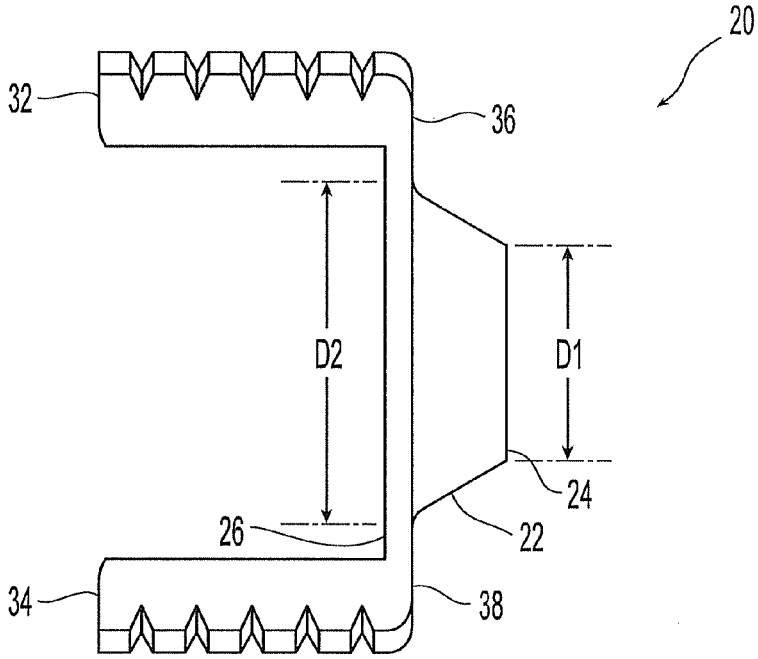
FIG. 2 is a left side elevational view of the tool of FIG. 1.
Figure 3:
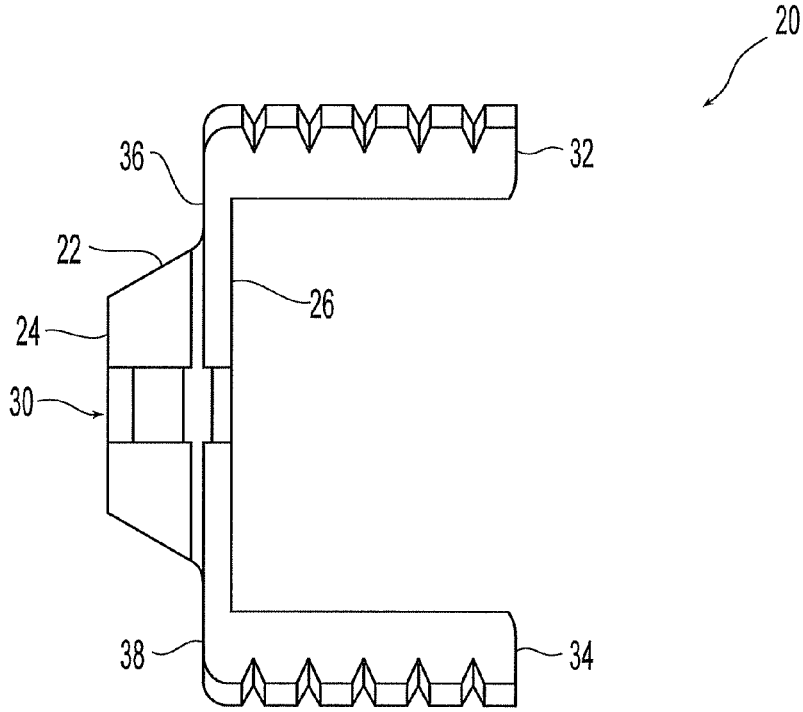
FIG. 3 is a right side elevational view of the tool of FIG. 1.
Figure 4:
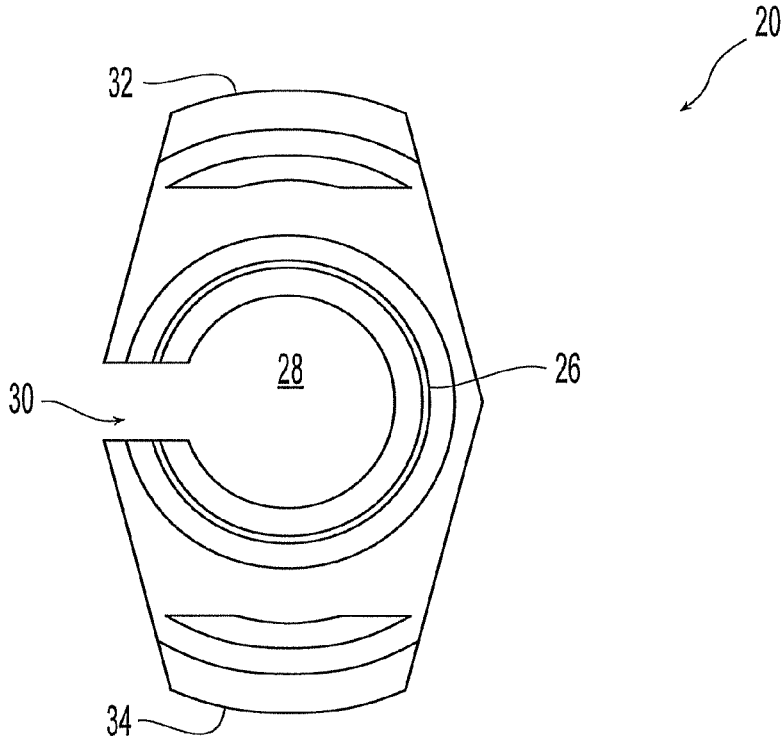
FIG. 4 is a rear elevational view of the tool of FIG. 1.
Figure 5:
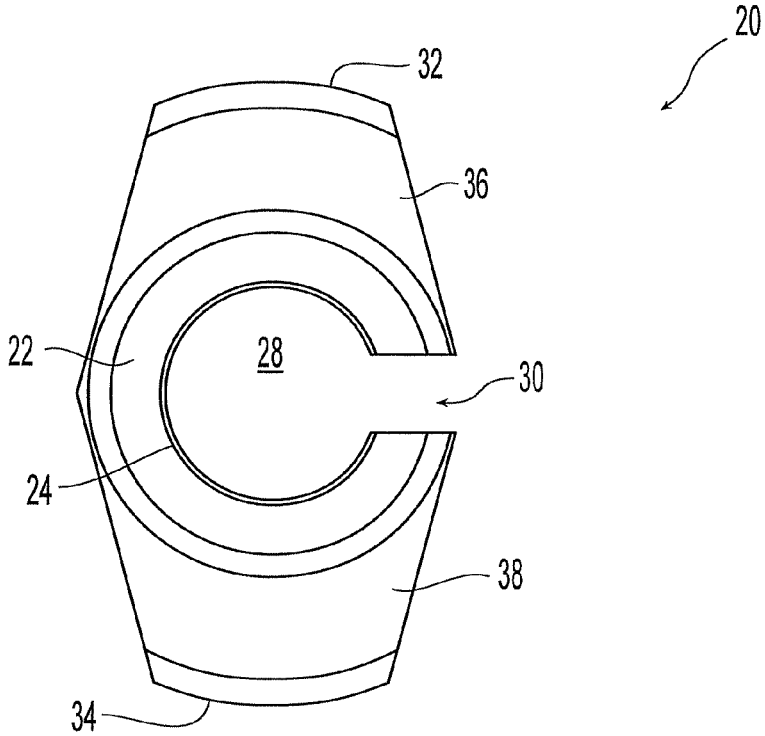
FIG. 5 is a front elevational view of the tool of FIG. 1.
Figure 6:
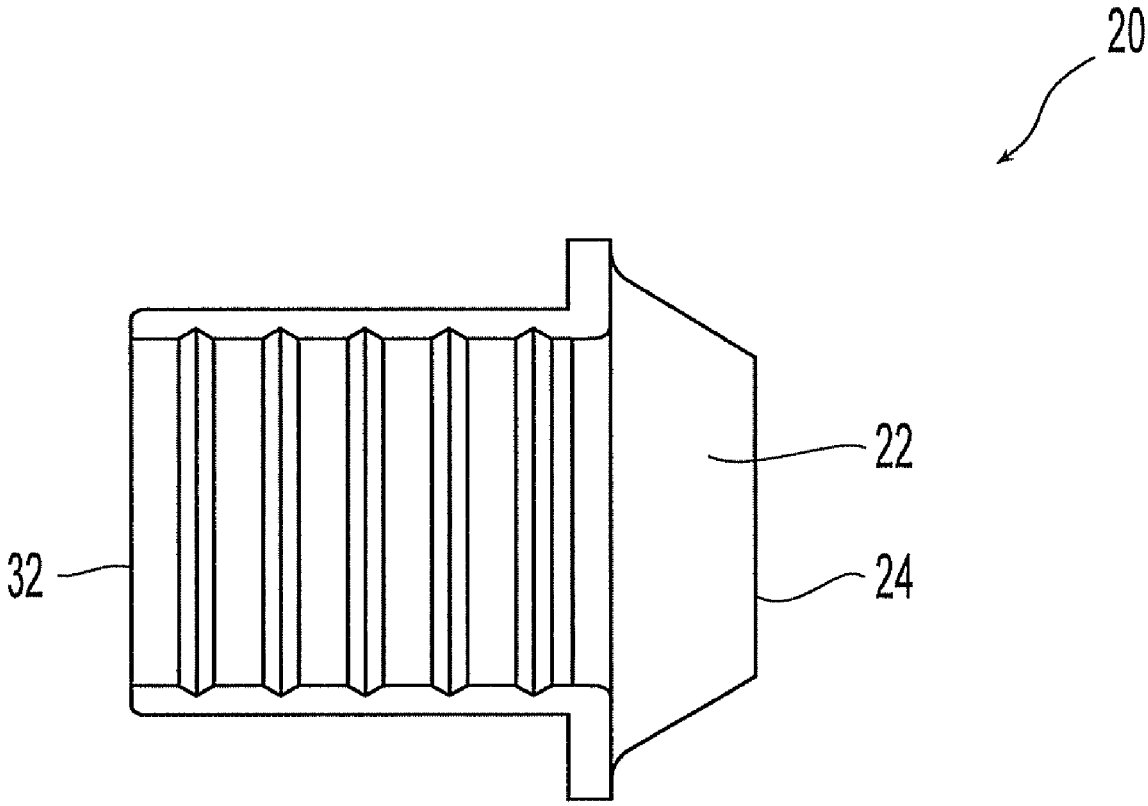
FIG. 6 is a top view of the tool of FIG. 1, the bottom view being the same.

Reference will now be made in detail to the present preferred embodiment(s) of the invention, examples of which are illustrated in the accompanying drawings. Whenever possible, the same reference numerals will be used throughout the drawings to refer to the same or like parts.

Referring to FIGS. 1-6, a tool 20 has a generally circular first portion 22 having a front end 24 and the rear end 26 with an opening 28 extending therebetween to receive a portion of an electrical connector, as discussed below. The front end 24 has a first diameter D1 and the rear end 26 has a second diameter D2, with the first diameter D1 being smaller than the second diameter D2. The generally circular first portion 22 also includes an opening 30 along the side and between the front end 24 and the rear end of 26. While the opening 30 is illustrated to be generally rectangular, the opening 30 could be of any shape and/or configuration and still fall within the scope of the present invention. Additionally, while the opening 30 is illustrated to be on the right side of the tool 20, it could also be on the left side as well.

The tool 20 also has two extensions 32,34 connected to the rear end 26 of the generally circular first portion 22. The two extensions 32,34 extend generally away from the front end 24 of the generally circular first portion 22. The extensions 32,34 are preferably connected to the rear end 26 of the generally circular first portion 22 by a projection 36,38 extending radially from the rear end 26 of the tool 20. As discussed in more detail below, the extensions 32,34 and the projections 36,38 extent radially beyond the body of the electrical connector. Also as illustrated in the figures, the extensions 32,34 are preferably on opposite sides of generally circular first portion 22 (i.e., 180° apart from one another).

When a user presses on the extensions 32,34, the generally circular first portion 22, and in particular first diameter D1 of the front end 24, becomes smaller and presses on the connector on which the tool 20 has been mounted. The generally circular first portion 22 becomes smaller in diameter as a result of the narrowing of the opening 30 extending along one side of first portion 22. Similarly, the rear end 26 (and diameter D2) become smaller, but rear end 26 does not necessarily engage any portion of the electrical connector on which it has been mounted.

Figure 8:
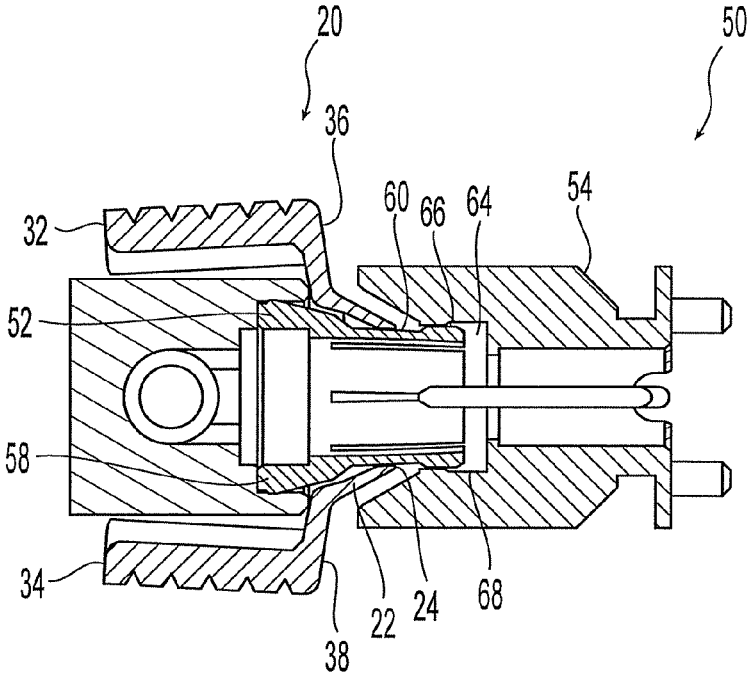
FIG. 8 is a cross sectional view of the tool being compressed and the two connector bodies of the electrical connector being separated from one another.
Figure 9:
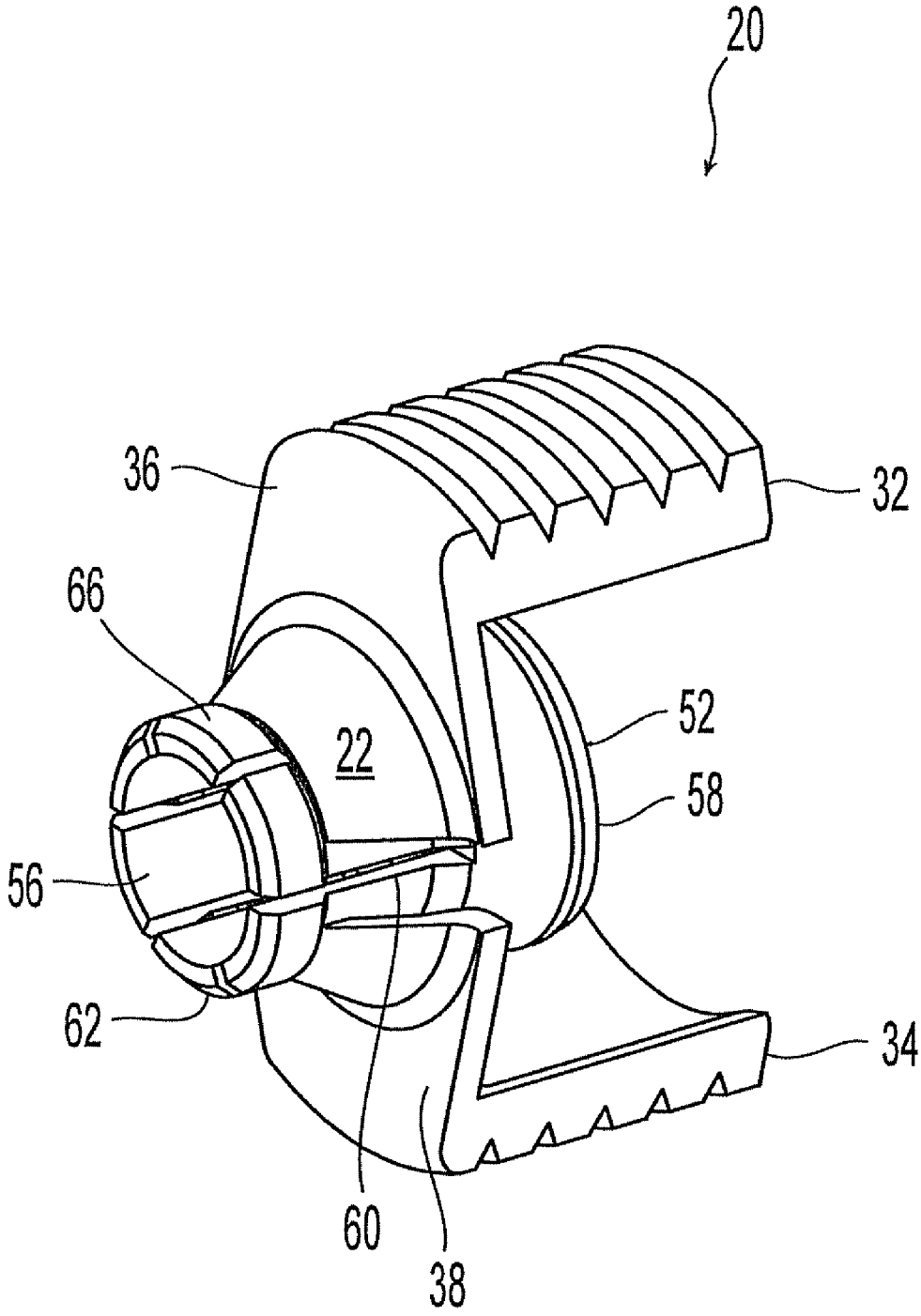
FIG. 9 is a perspective view of the tool mounted on a first connector body of the electrical connector according to the present invention.

The operation of tool 20 in connection with electrical connector 50 will now be explained with reference to FIGS. 7 and 8. The electrical connector 50 has a first connector body 52 and a second connector body 54. The first connector body 52 has a front end 56, a back end 58, and a middle portion 60. The first connector body 52 also has at least two spring fingers 62 (and six are illustrated in FIG. 9) extending between the front and 56 in the middle portion 60. As is known in the art, the spring fingers 62 allow for compression and expansion of the first connector body 52. Prior to assembly of electrical connector 50, the tool 20 is placed over the front end 56 of the first connector body 52. See FIG. 9. The first connector body 52 with the tool 20 is then inserted into an opening 64 of second connector body 54. Projections 66 at the front end 56 of the first connector body 52 (and on the spring fingers 62) engage an annular groove 68 in the opening 64 of the second connector body 54. The engagement of the projection 66 in the annular groove 68 prevents the first connector body 52 from being demated from the second connector body 54. However, by pressing on extensions 32,34, the front end 24 of tool 20 becomes smaller and presses on the spring fingers 62, withdrawing the projections 66 from the annular groove 68 and allowing the first connector body 52 to be removed axially from second connector body 54.

Figure 7:
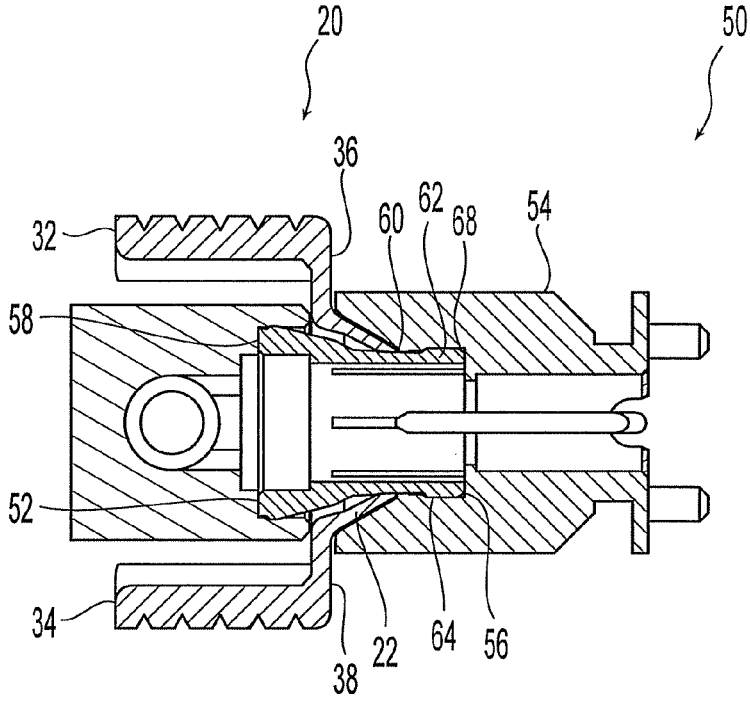
FIG. 7 is a cross sectional view of the tool mounted on an electrical connector according to the present invention.

As can be seen in FIG. 7, the tool 20 fits between the first connector body 52 and the second connector body 54. The projections 36,38 extend radially outward beyond the outer surfaces of the first connector body 52 and the second connector body 54 so that the user can easily grasp the extensions 32,34 and have enough space to compress them (and the front end 24) and compress the spring fingers 62 to allow for demating of the first connector body 52 and the second connector body 54. The tool 20 also provides for some additional anti-rocking of the two connector bodies and, if made from appropriate materials, additional RF leakage protection.

It should be noted that the tool 20 can be used with any sized electrical connector and with any configuration of electrical connector. The electrical connector illustrated in FIGS. 7 and 8 is a right-angled GPPO brand connector available from the assignee containing the first connector body 52 and the second connector body 54 (a male coplanar surface mount) for connection to a PCB board. However, the tool 20 could work with many other configurations and sizes of electrical connectors, provided one portion has spring fingers 62 that engage an annular groove (such as groove 68) to assist in coupling of the two connector bodies.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. An electrical connector for connecting a printed circuit board and a coaxial cable comprising:

a first connector body having a front end, a back end, and a middle portion, and having at least two spring fingers between the front end and the middle portion;

a tool to release the first connector body having a generally circular first portion to engage the at least two spring fingers, said generally circular first portion having a front end and rear end and an opening therebetween for receiving a portion of the first connector body, the front end having a first diameter and the rear end having a second diameter, the first diameter being smaller than the second diameter, and at least two extensions connected to the first portion and extending beyond the first connector body, wherein pressing on the at least two extensions toward each other compresses the at least two spring fingers; and a second connector body having an opening therein to receive at least a portion of the tool and at least a portion of the first connector body.

2. The electrical connector according to claim 1, wherein the tool includes an opening extending along a side of the first portion between a front end and a rear end thereof.

3. The electrical connector according to claim 1, wherein pressing on the at least two extensions toward each other causes the first diameter to become smaller.

4. The electrical connector according to claim 1, wherein pressing on the at least two extensions toward each other causes the second diameter to become smaller.

5. The electrical connector according to claim 1, further comprising a projection radially extending from the rear end of the first portion to connect each of the at least two extensions to the first portion, the projections being sized to extend beyond the first connector body.

6. The electrical connector according to claim 1, wherein the at least two projections are on opposite sides of the first portion.

7. The electrical connector according to claim 1, wherein pressing on the at least two extensions toward each other on the tool compresses the at least two spring fingers on the first connector body to allow it to be removed from the second connector body.

* * * * *